US008966670B2

(12) United States Patent
Cheng

(10) Patent No.: US 8,966,670 B2
(45) Date of Patent: Mar. 3, 2015

(54) SPORTS SAFETY HELMET

(75) Inventor: Norman Tien-Hou Cheng, Kowloon (HK)

(73) Assignee: Strategic Sports Limited, Hong Kong (HK)

( * ) Notice: Subject to any disclaimer, the term of this patent is extended or adjusted under 35 U.S.C. 154(b) by 0 days.

(21) Appl. No.: 13/176,782

(22) Filed: Jul. 6, 2011

(65) Prior Publication Data

US 2012/0005810 A1 Jan. 12, 2012

(30) Foreign Application Priority Data

Jul. 9, 2010 (GB) ..... 1011598.8

(51) Int. Cl.
*A42B 3/00* (2006.01)
*A42B 3/06* (2006.01)

(52) U.S. Cl.
CPC .. *A42B 3/06* (2013.01); *A42B 3/063* (2013.01)
USPC ..... 2/411; 2/410; 2/171.3; 2/414; 2/425

(58) Field of Classification Search
CPC ..... A42B 3/063; A42B 3/066; A42B 3/069
USPC ..... 2/425, 424, 171.3, 410, 422, 171.4, 2/184.5, 171.7, 411, 8.3, 414, 421, 10, 12
See application file for complete search history.

(56) References Cited

U.S. PATENT DOCUMENTS

| | | | | |
|---|---|---|---|---|
| 3,500,475 | A | 3/1970 | Otsuka | |
| 4,996,724 | A * | 3/1991 | Dextrase | 2/411 |
| 5,565,155 | A | 10/1996 | Cheng-Hung | |
| 5,915,537 | A * | 6/1999 | Dallas et al. | 2/410 |
| 6,658,671 | B1 * | 12/2003 | Von Holst et al. | 2/412 |
| 2006/0130219 | A1 * | 6/2006 | Burek et al. | 2/421 |
| 2007/0136932 | A1 * | 6/2007 | Muskovitz et al. | 2/410 |
| 2007/0220662 | A1 | 9/2007 | Pierce | |
| 2008/0250546 | A1 | 10/2008 | Watabiki et al. | |

FOREIGN PATENT DOCUMENTS

| | | |
|---|---|---|
| GB | 2021470 A | 12/1979 |
| WO | WO96/22710 | 8/1996 |
| WO | WO2007/041656 | 4/2007 |

* cited by examiner

*Primary Examiner* — Danny Worrell
*Assistant Examiner* — Khaled Annis
(74) *Attorney, Agent, or Firm* — Reed Smith LLP

(57) ABSTRACT

A safety helmet having an outer shell formed from a polycarbonate crown and an acrylonitrile butadiene styrene skirt, and an inner shell formed from expanded polystyrene. The inner shell is co-moulded with the outer shell.

5 Claims, 3 Drawing Sheets

SPORTS SAFETY HELMET

CROSS-REFERENCE TO RELATED APPLICATION

This application claims the benefit under 35 U.S.C. §119 of the earlier filing date of United Kingdom application Ser. No. UK 1011598.8, filed Jul. 9, 2010. The aforementioned patent application is expressly incorporated herein by reference in its entirety.

TECHNICAL FIELD

This invention relates to improvements in the design of safety helmets for sports such as snowboarding, skiing, motorcycling, cycling, equestrian sports and skating.

BACKGROUND OF THE INVENTION

It is known for protective head gear to be worn by people undertaking sports where there is a risk of impact to the head. A range of helmets are produced, usually with a specific sport in mind. For snow sports such as skiing and snow boarding there are two main types of protective helmet. The first of these uses an injection moulded acryonitrile butadiene styrene (ABS) shell having a glued-in liner of expanded polystyrene (EPS). Using ABS provides a strong shell, and this kind of helmet is relatively inexpensive. However, ABS is heavy as well as durable. It is known that heavier helmets can increase the risk of injury to the wearer's head and neck, particularly when it comes to rotational injuries.

A lighter form of helmet can be made by using a vacuum formed polycarbonate (PC) shell. It is also known to line a PC shell with injected EPS, forming a bonded lining. Bonding a liner to a helmet shell in this way improves the structure of the helmet and increases strength. However, while PC can be used to form a lighter shell than ABS, it is not as durable and can be more easily damaged on impact.

What is required is a helmet with an improved strength to weight ratio; that is one having optimum structural strength and impact resistance while being as light as possible. Such a helmet should also meet appropriate safety standards and be inexpensive to produce.

SUMMARY OF THE INVENTION

According to the present invention there is provided a safety helmet comprising an outer shell and an inner shell, wherein the outer shell comprises a crown of thermoplastic polymer and a skirt substantially of thermoplastic polymer. Preferably, the crown is of polycarbonate. Preferably, the skirt is of acrylonitrile butadiene styrene. The inner shell may comprise a liner of expanded polystyrene, co-moulded with the outer shell. Preferably, the inner shell is co-moulded with both the crown and the skirt of the outer shell.

In a further embodiment, the crown has a return edge, which may be continuous, and which may comprise an in-turned flange. The skirt may also have a return edge, which again may be continuous. The crown and/or the skirt may have air vents, and the helmet may have a brim and/or a chin strap.

A return edge improves bonding and location of the crown and/or skirt with the EPS liner, and also provides a neat external appearance. The return edge of one of the crown and skirt may provide form locking with the other.

There are numerous advantages to a helmet having an outer shell comprising the above combination of PC and ABS. As previously stated, ABS is stronger and more impact resistant than PC, so is used at structurally weaker areas around the helmet skirt. The structurally stronger crown of the helmet does not need to be made from ABS, so the lighter PC may be used. The strength of the outer shell is improved by co-moulding the EPS liner to both the PC and the ABS.

Another advantage to the PC/ABS combination is cost reduction. Injection-moulding is more expensive than vacuum-forming, so keeping the amount of ABS used to a minimum reduces mould cost. Yet another advantage is that of weight—using PC where possible keeps the weight of the helmet low, and thus may decrease damage to the wearer's head and neck in the event of a rotational injury. Yet a further advantage is that of size reduction. Bulky safety helmets can be seen as unfashionable, leading to low use of helmets, particularly amongst participants in image-conscious snow sports. Co-moulding the inner shell to the outer shell improves the strength of the outer shell such that it may be thinner, improving the appearance of the helmet and thus making it more desirable to potential wearers. Normally, injection moulded shells are more than 3 mm thick. Due to the additional strength provided by the co-moulding process, the thickness of the injection-moulded portion can be reduced to less than 3 mm.

There is also provided a method of making a safety helmet comprising the steps of a) vacuum forming a crown of thermoplastic polymer;
b) injection moulding a skirt of thermoplastic polymer;
c) placing the crown and skirt in a pre-determined relative position; and
d) in-moulding a lining of expanded polystyrene.

This method has the advantage of retaining the crown and the skirt in a fixed relationship. A further advantage can be achieved by fixing the return edges of the crown and skirt, for example by interlocking, prior to in-moulding of the liner, as this would provide location features for positioning in step c).

As with the materials, there are advantages to the methods of manufacture used. Injection-moulding is used to create a stronger, more impact resistant area around the skirt, whilst vacuum-forming can be used to create the structurally stronger crown of the helmet.

BRIEF DESCRIPTION OF DRAWINGS

Other features of the invention will be apparent from the following description of a preferred embodiment of the invention, shown by way of example in the accompanying drawings in which.

DETAILED DESCRIPTION OF THE INVENTION

Figure 1:
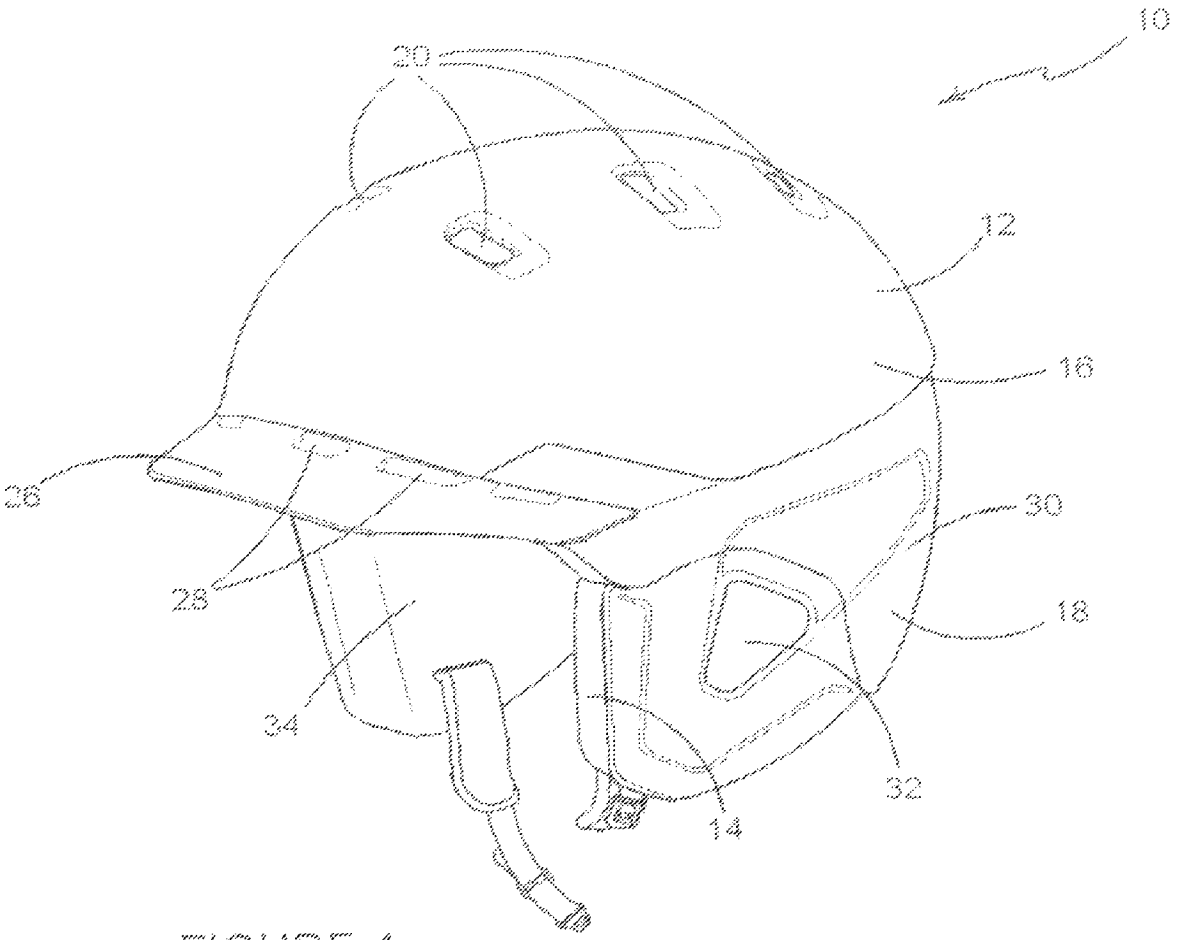
FIG. 1 shows a perspective view of a helmet according to the present invention.
Figure 2:
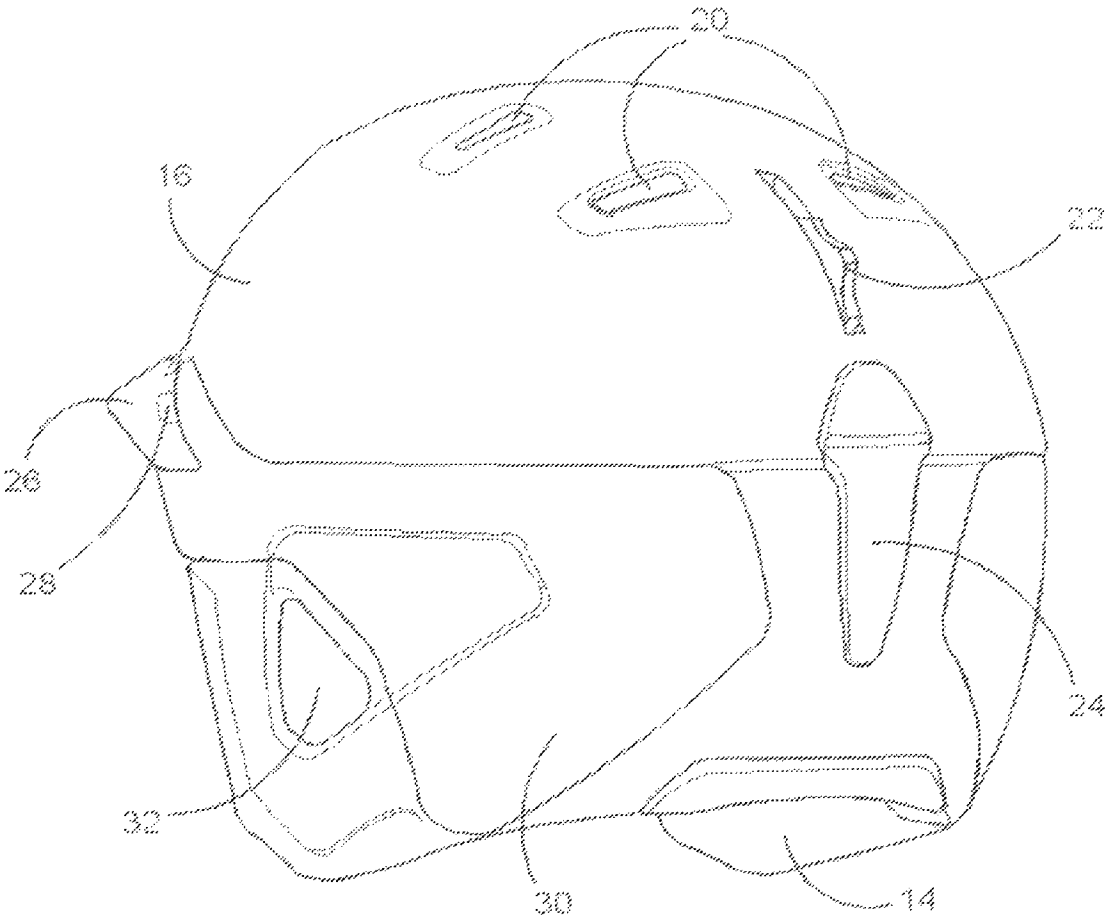
FIG. 2 shows a rear perspective view of the embodiment of FIG. 1.

With reference to the drawings, a helmet 10 comprises an outer shell 12 and an inner shell 14. The outer shell 12 has an upturned-bowl shaped crown 16 and a skirt 18 descending from the edge of the crown 16. In use, the skirt 18 covers the wearer's temples, protrudes down the cheeks to the jaw line, and extends around the back of the wearer's head, covering roughly two thirds of the periphery of the crown. The skirt 18 is preferably slightly concave, following the shape of the wearer's head. The skirt 18 and the crown 16 fit together to form a substantially continuous convex surface.

The outer shell 12 has six air vents 20 positioned in two rows of three on either side of the top of the crown 16. The air vents 20 are adjustable, and can be opened or closed by a sliding mechanism 22 positioned towards the centre rear of the crown 16, A goggle strap holder 24 is attached to the rear of the outer shell 12 below the sliding mechanism 22. In this embodiment, the helmet 10 comprises a brim 26 at the front of the crown 16. The brim 26 has air vents 28 positioned along the join of the brim 26 and the crown 16.

The skirt 18 comprises two side panels 30 of less than 3 mm thick injection-moulded acrylonitrile butadiene styrene (ABS), one positioned on either side of the helmet 10. Each side panel 30 has an ear vent 32. The crown 16 and the remaining parts of the skirt 18 are 2 mm thick vacuum-formed polycarbonate (PC).

The inner shell 14 is an expanded polystyrene (EPS) liner 34, of thickness ranging from 15 mm to 25 mm, co-moulded to the outer shell 12 during manufacture. The liner 34 is thickest at the crown 16 (see FIG. 3). The thickness of the liner 34 is increased at the crown 16 in order to allow impact energy to be absorbed. The liner 34 has air vents (not shown) aligned with the air vents 20 of the outer shell 12.

Figure 3:
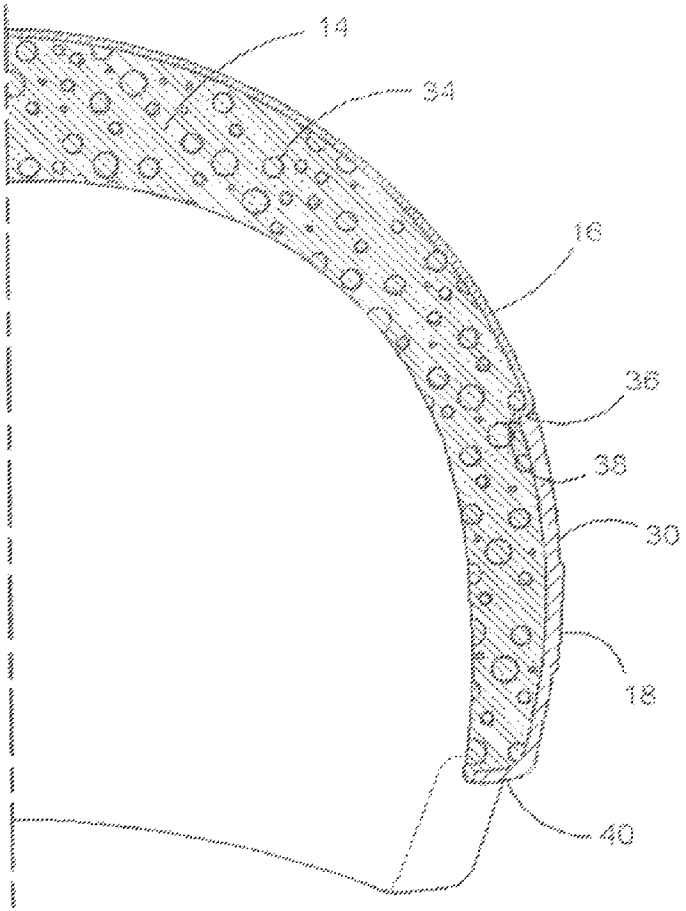
FIG. 3 shows a cross-sectional view of the embodiment of FIG. 1.

FIG. 3 shows a cross-sectional view through a part of the helmet 10. The arrangement of the crown 16, skirt 18 and liner 34 is clearly shown, The crown 16 comprises a return edge 36 extending into the liner 34 substantially orthogonal to the crown. The return edge 36 has a rim 38 which extends downwardly into the liner 34, substantially orthogonal to the return edge 36. The skirt 18 also comprises a return edge 40, which extends beneath the lower edge of the liner 34 substantially orthogonal to the skirt 18. The return edge 40 does not extend fully over the bottom of the liner 34, so that no sharp edge comes into contact with the wearer.

The method of manufacture of the helmet 10 involves vacuum forming the PC crown 16 and injection moulding the ABS side panels 30. The outer shell parts are placed in the required position in a mould (not shown), which is then closed. EPS is injected into the mould to form the liner 34. Apertures are left for the fitting of any chin straps or other features.

This method is advantageous in that the liner is used to retain the parts of the outer shell in a fixed relationship. The edges of the outer shell parts can be designed to interlock to strengthen that relationship.

Further advantages of the invention include that the crown return edge 36 provides a seat for the skirt 18. The skirt return edge 40 prevents damage to the liner 34 when the helmet 10 is not being worn, for example damage caused by placing the helmet 10 on a rough surface. As the ABS side panels 30 are injection moulded, their thickness may be varied, allowing an optimum protection/weight ratio to be achieved. Material can be added at areas where most protection is required, but need not be added over the whole of a panel. Fixings for chin straps can be moulded in to the strong ABS. Contrasting colours of PC and ABS may be used to create a distinctive design.

In further embodiments of the invention the skirt may comprise a single panel of injection-moulded ABS extending around the helmet, or the whole of the skirt 18 may be ABS. Alternatively, more than two ABS panels may be included in the skirt. The helmet may have a chinstrap. The return edges 36, 40 may provide form-locking of the crown and skirt so that the strength of the outer shell is improved and the parts may be easily located during manufacture.

The invention claimed is:

1. A safety helmet comprising:

an outer shell and an inner shell, wherein the outer shell comprises a first part and a second part, the first part comprising a crown and the second part comprising a skirt;

wherein the skirt descends from an edge of the crown;

wherein the crown and skirt together form a continuous convex surface;

wherein the inner shell has a lower edge;

wherein the skirt has a skirt return edge extending orthogonally to the skirt across at least a portion of the lower edge of the inner shell;

wherein the skirt return edge is continuous;

wherein the edge of the crown has a crown return edge having an in-turned flange forming a seat for the skirt;

wherein the in-turned flange extends into the inner shell orthogonal to the crown;

wherein the crown return edge has a rim which extends downwardly into the inner shell orthogonal to the in-turned flange;

wherein the crown return edge is continuous;

wherein the skirt return edge and the crown return edge provide form-locking of the crown and skirt;

wherein the crown comprises a first thermoplastic polymer material;

wherein the skirt comprises a second thermoplastic polymer material that is a different material from the first thermoplastic polymer material;

wherein the second thermoplastic polymer material is stronger and more impact resistant than the first thermoplastic polymer material wherein the first thermoplastic polymer material is vacuum-formed polycarbonate; and wherein the second thermoplastic polymer material is injection-moulded acrylonitrile butadiene styrene; and wherein the inner shell comprises a liner of expanded polystyrene, co-moulded with the crown and the skirt of the outer shell, wherein the co-moulded liner maintains the crown and skirt of the outer shell in a fixed relationship.

2. A safety helmet according to claim 1 wherein the crown comprises air vents.

3. A safety helmet according claim 1 wherein the skirt comprises air vents.

4. A safety helmet according claim 1 further comprising a brim.

5. A safety helmet according claim 1 further comprising a chin strap.

* * * * *